United States Patent [19]

Patterson

[11] 4,424,799

[45] Jan. 10, 1984

[54] AUTOMATIC ADJUSTABLE AIR BAFFLE

[76] Inventor: Tommy W. Patterson, P.O. Box 65, Hayesville, Ohio 44838

[21] Appl. No.: 225,023

[22] Filed: Jan. 14, 1981

[51] Int. Cl.[3] ..... F23L 3/00

[52] U.S. Cl. ..... 126/289; 126/287

[58] Field of Search ..... 126/287, 307 A, 289, 126/60, 290, 286

[56] References Cited

U.S. PATENT DOCUMENTS

| | | | |
|---|---|---|---|
| 529,622 | 11/1894 | Knauss | 126/289 |
| 1,066,962 | 7/1913 | Walker et al. | 126/287 |
| 1,655,055 | 1/1928 | Glass | 126/287 |
| 2,444,402 | 6/1948 | Klein | 126/287 |
| 2,665,683 | 1/1954 | Snook | 126/288 |
| 4,015,587 | 4/1977 | Wincek | 126/288 |
| 4,030,479 | 6/1977 | Webb | 126/287 |
| 4,280,476 | 7/1981 | Webb | 126/287 |
| 4,287,875 | 9/1981 | Mayes | 126/288 |
| 4,337,753 | 7/1982 | McGinn | 126/289 |

FOREIGN PATENT DOCUMENTS

| | | | |
|---|---|---|---|
| 64181 | 8/1938 | Norway | 126/287 |
| 569964 | 6/1945 | United Kingdom | 126/287 |

*Primary Examiner*—James C. Yeung

*Attorney, Agent, or Firm*—Oldham, Oldham, Hudak, Weber & Sand Co.

[57] ABSTRACT

A wood or coal-burning stove or fireplace has a baffle attached to a flue. Upon opening of the stove door or the fireplace door, the baffle is automatically adjusted to increase the amount of air admitted to the stove or fireplace and thus prevents smoke from coming out of the doors.

11 Claims, 4 Drawing Figures

AUTOMATIC ADJUSTABLE AIR BAFFLE

TECHNICAL FIELD

The present invention relates to a heating stove or a fireplace having an automatically air-adjusted baffle which increases the amount of air intake through the door upon opening of the same.

BACKGROUND ART

Heretofore stoves or fireplaces commonly utilized for heating, for example wood or coal-burning, have often had no baffle. Thus, upon opening of the doors, smoke would be admitted to the heating area. At times, a back draft would even develop admitting not only the stove but also flames into the room area.

Stoves or fireplaces which heretofore have contained a baffle, have all been manually operated so that upon the initial opening of the door, smoke would generally enter the room.

DISCLOSURE OF INVENTION

It is therefore an object of the present invention to provide an automatic adjustable air baffle increasing the amount of air intake when a stove or fireplace door is opened.

It is yet another object of the present invention to provide an automatic adjustable air baffle, as above, wherein said baffle is located in the upper portion of a stove firebox or in a chimney flue.

It is still another object of the present invention to provide an automatic adjustable air baffle, as above, wherein said baffle is automatically further opened upon opening of said door.

It is yet another object of the present invention to provide an automatic adjustable air baffle, as above, wherein one end of a rod is connected to said baffle and the other end bears against said door, so that upon opening of said door, said baffle is automatically adjusted to increase the amount of air admitted to the flue.

It is yet another object of the present invention to provide an automatic adjustable air baffle, as above, wherein said baffle pivots about a rod attached to the lower portion of the baffle.

It is a still further object of the present invention to provide an automatic adjustable air baffle, as above, wherein an adjustable air inlet exists on the bottom portion behind said door.

In general, an automatic baffle for a fire container, comprises: a flue vent in the fire container, said container having an opening; a door covering said opening; the baffle, said baffle located in said flue portion of said container; and a connecting rod means for connecting said door to said baffle so that upon opening of said door, said baffle is adjusted to increase the amount of air intake into said flue.

Additionally, an automatic baffle for a fireplace or a stove, comprises: a baffle, said baffle having an arm; a connecting rod, one end of said connecting rod connected to said baffle arm, said baffle capable of movement about a point so that upon movement of said connecting rod, said baffle is opened.

BRIEF DESCRIPTION OF DRAWINGS

For a better understanding of the invention, reference should be had to the accompanying drawings, wherein.

BEST MODE FOR CARRYING OUT THE INVENTION

Figure 3:
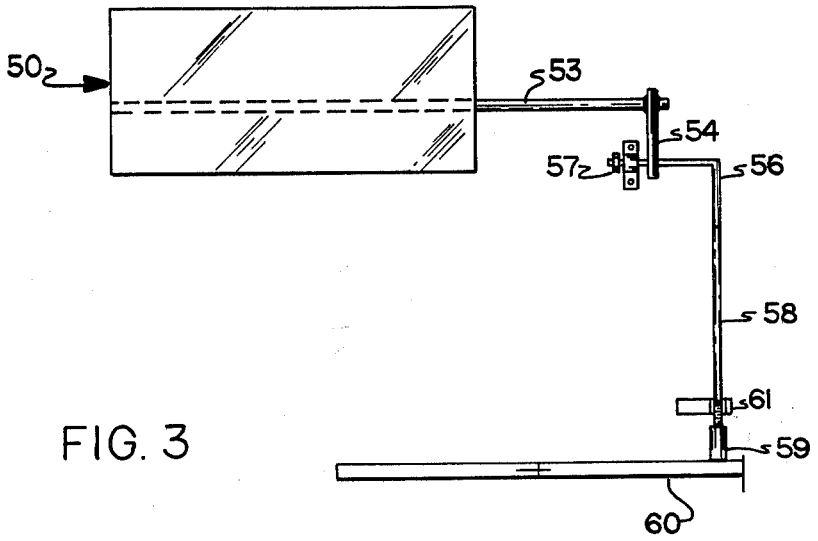
FIG. 3 is a top elevational view showing the automatic adjustment system.

The automatic adjusted baffle of the present invention can be located either in a fire container such as a stove or a fireplace having a door covering the fireplace opening. Considering the stove, it can be a step stove as generally indicated by the numeral 10. In addition to burning wood, the stove can burn coal. Heating stove 10 has sidewalls 12, a back stove heat exchanger portion generally indicated by the number 14, and a top platen portion with flue vent 17 therein. The stove also contains a front heat ejection portion 18 which has apertures 19 therein. Generally, this heating portion is sloped with respect to the horizontal, generally anywhere from a 30 to about a 60 degree angle. Extending forward from the heat ejection portion is lower top portion 22. Floor 24 is connected to back portion 14 as well as side walls 12.

Figure 2:
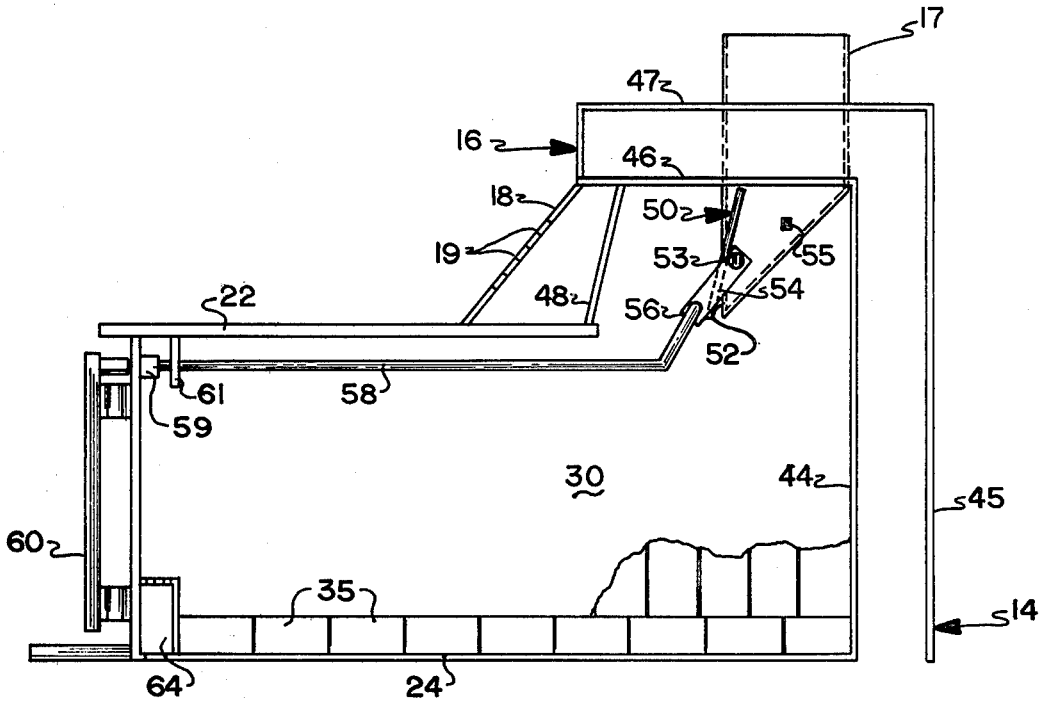
FIG. 2 is a side cross-sectional elevational view of the stove.

The heating stove has a firebox generally indicated by the numeral 30. The firebox typically has floor 24 covered with firebricks 35 as shown in FIG. 2. Moreover, the lower portion of sidewall 12 and back portion 14 is also lined with firebrick to keep a great amount of the heat from being transferred through such portions to the outside air. The upper portions of sidewalls 12 and back portion 14 are not lined. As best seen in FIG. 2, air is drawn into the stove through back stove heat exchanger portion 14, over the top stove portion 16, and out through front ejection portion 18. Generally, any conventional air intake including a fan (not shown) may be utilized to force the air through the stove. The structural features of the heat exchanger system included back wall 44 which constitutes a portion of the firebox, and outside backwall 45. The opening between the two walls constitutes a heat exchanger through which the outside air is forced through. The heated air is further forced through top portion 16 between top wall 46 and outside top wall 47. From there the air is forced through heat ejection apertures 19 and fire box shroud 48 out into the room.

Figure 1:
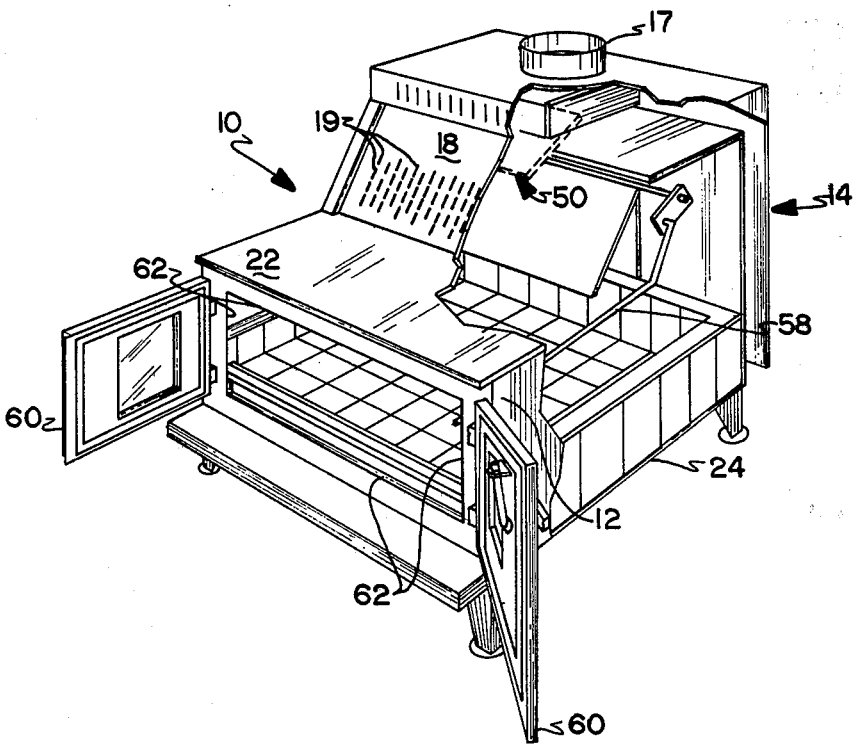
FIG. 1 is a perspective view of a free-standing stove of the present invention having a cut-away portion showing the automatic baffle.

The stove has doors 60 as shown in FIG. 1. The doors may be of any conventional type and desirably are airtight double doors with panels of a high temperture glass such as Pyroceran manufactured by Corning. The airtight doors help control the fire for maximum efficiency and reduce wood consumption. They also keep soot, smoke, and sparks from blowing into the room. The doors serve to seal off door opening or aperture 62, through which, when the doors are opened, wood or coal can be inserted into the stove, the stove stoked, or the like. During normal operation of the stove, air will enter the stove through intake channels generally indicated by the numeral 64. As seen in FIG. 1, the area of the air inlet can be varied through adjustable tabs (not shown) which slide across the channel opening. As shown, desirably intake channels 64 are located behind door 60 at the bottom or base portion of the stove.

A baffle which automatically admits more air to the stove flue upon opening of doors 60 is generally indicated by the numeral 50. Baffle 50 is generally attached to the flue opening in any conventional manner. Baffle 50 can generally reside at a vertical inclination with regard to the flue opening 52. However, upon opening of door 60, baffle 50 is automatically adjusted towards a horizontal position to more fully open and increase the amount of air drawn up the flue or the chimney. A specific arrangement is shown in FIGS. 2 and 3.

As shown in FIGS. 2 and 3, a connecting rod 58 has one end which bears against a door 60. Rod 58 is supported through bracket 61 which may have a slot or aperture therein through which the rod may slide. The other end of the rod has a pin 56 which has a nut 57 attached to the end thereof. Pin 56, which can be merely an extension of or part of connecting rod 58, resides within a tab 54 having an aperture therein. Tab 54 is welded to baffle rod 53 which is attached to baffle 50. Thus, movement of connecting rod 58 at the door will cause pin 56 to rotate baffle 50 about a rod 53, thus opening or closing the baffle. As best seen in FIG. 2, the end of rod 58 is attached to threaded bracket 59 so that the baffle opening may be adjusted when the door is closed. According to the present invention, baffle 50 is generally contained at an almost closed position. That is, it is normally opened a sufficient amount to allow fire to maintain combustion within fire box 30. However, upon opening of door 60, connecting rod 58 moves forward or to the left as shown in FIG. 2, thereby causing baffle 50 to rotate and enlarging the amount of air escaping up the flue. As seen in FIGS. 2 and 3, the automatic opening is produced by attaching baffle rod or arm 53 to the lower back portion of the baffle. Thus, the weight of the upper portion of the baffle will pivot about rod 53 causing the baffle to rotate towards a horizontal position against stop 55 and thereby permit a much larger amount of air to escape up the flue and the chimney.

Of course, other structures can be utilized so that the baffle automatically opens, for example, a top baffle portion having a greater weight than the bottom portion, a spring-loading baffle, and the like. Naturally, the size of the baffle may vary from stove to stove. For example, it may be approximately 11½ inches wide by 7 inches high by a quarter-inch thickness in the embodiment shown. The arrangement is completely automatic and, with the added amount of air drawn up the chimney, ensures that smoke and the like is not admitted into a room when a baffle door 60 is open. A typical air intake opening of baffle 50 ranges from about 1 inch, that is about 11½ square inches, when the doors are closed, to approximately 50 square inches when the doors are open.

Figure 4:
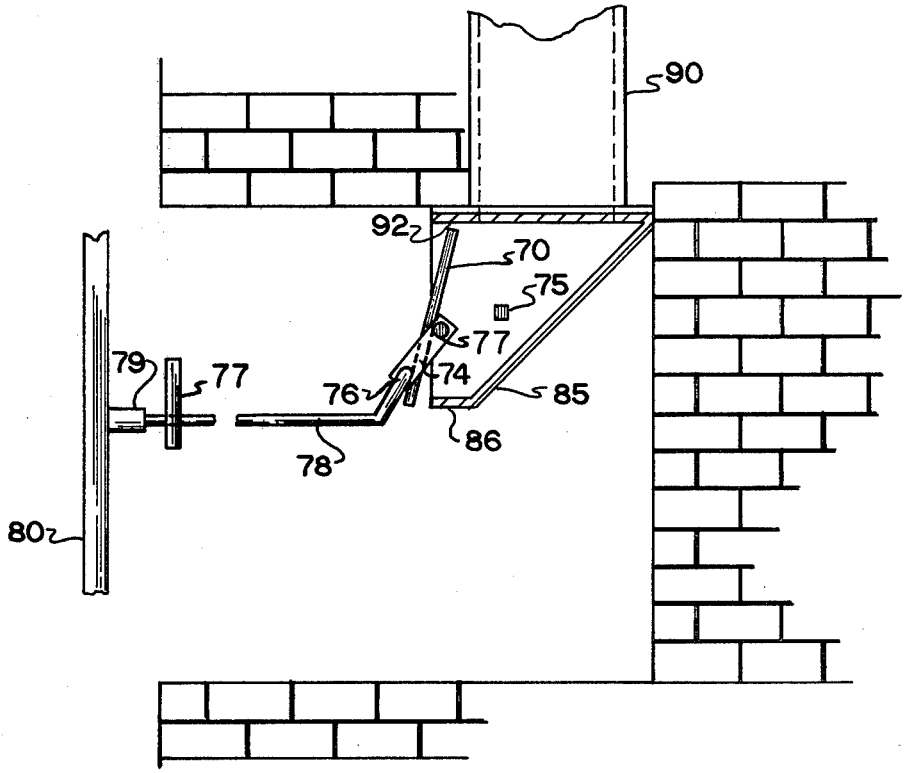
FIG. 4 is a side elevational view of the automatic baffle located in a chimney.

Considering the use of the automatic adjustable baffle in a masonary fireplace having doors covering the entrance, reference is had to FIG. 4. In FIG. 4 automatic adjustable baffle 70 may be the same or similar to that shown in FIG. 2. That is, it may have a baffle rod 73 which is mounted on the lower portion of the baffle so that upon movement of connecting rod 78, the baffle will pivot around rod 73 and assume more of a horizontal position and contact baffle stop 75. As before, rod 78 extends forwardly and bears against a door 80. Door 80 may be a permanent door installed over the opening face of the fireplace or it may be a door set designed to cover the opening of a fireplace. Rod 78 has a threaded end which engages threaded receptacle 79 so that the baffle can be adjusted to a desired opening when the door is closed, so that the fire may burn. One end of rod 78 is supported by a bracket 77 having a slot therein. The other end of connecting rod 78 is attached to tab 74 through pin 76 which extends from rod 78 through tab 74 and is fastened thereto by a nut (not shown). Tab 74 is attached to baffle rod 73 as by welding, etc.

Generally, the baffle is mounted in the vicinity of flue 90. Typically, the baffle, when fully closed, will reside against a forward portion of the flue opening 92 and the lower lip 86 of plate 85. Normally, the flue is surrounded by brick and masonary on three sides. Baffle stop 75 may be mounted on the side of the flue opening and be a peg extending from the wall or a lower portion of the flue housing.

In accordance with the patent statutes, only the best mode and preferred embodiment of the invention has been illustrated and described in detail, it is to be understood that the invention is not limited thereto, but that the scope is defined by the appended claims.

What is claimed is:

1. An automatic baffle for a fire container, comprising:

a flue vent in the fire container, said container having an opening, a door covering said opening and normally being in a closed position, the automatic baffle, said baffle located in said flue vent of said container, a baffle rod, said baffle rod attached to said baffle, a connecting rod means with one end bearing against said door and the remaining end attached to said baffle rod for maintaining said baffle in a sufficient opened position to maintain combustion in said fire container, said baffle rod attached to said baffle off center so that the weight of said off center portion through said connecting rod bears against said door and causes said baffle to rotate about said baffle rod upon opening of said door and increases the amount of air intake into said flue.

2. An automatic baffle according to claim 1, wherein one end of said connecting rod bears against said door and the remaining end of said rod is connected to said baffle.

3. An automatic baffle according to claim 1, wherein said baffle rod has a tab thereon, said connecting rod connected to said tab.

4. An automatic baffle according to claims 1 or 3, wherein said automatic adjustable baffle is located in a wood or coal-burning stove.

5. An automatic baffle according to claim 4, including an air intake, said air intake located behind and to the bottom of said door.

6. An automatic baffle according to claim 4, including a threaded bracket, said connecting rod end bearing against said door adjustably engaging said threaded bracket.

7. An adjustable baffle according to claim 6, including a baffle stop, said baffle stop located in said flue vent.

8. An automatic baffle according to claims 1 or 3, wherein said automatic adjustable baffle is located in a fireplace.

9. An automatic baffle according to claim 8, including an air intake, said air intake located behind and to the bottom of said door.

10. An automatic baffle according to claim 8, including a threaded bracket, said connecting rod end bearing against said door adjustably engaging said threaded bracket.

11. An automatic baffle according to claim 2, including an air intake, said air intake located behind and to the bottom of said door.

* * * * *